US007274137B2

(12) United States Patent
Lee et al.

(10) Patent No.: US 7,274,137 B2
(45) Date of Patent: Sep. 25, 2007

(54) ELECTRON EMISSION DEVICE WITH EMISSION CONTROLLING RESISTANCE LAYER

(75) Inventors: Sang-Jo Lee, Suwon-si (KR); Chun-Gyoo Lee, Suwon-si (KR)

(73) Assignee: Samsung SDI Co., Ltd, Suwon-si (KR)

( * ) Notice: Subject to any disclaimer, the term of this patent is extended or adjusted under 35 U.S.C. 154(b) by 378 days.

(21) Appl. No.: 10/932,686

(22) Filed: Sep. 1, 2004

(65) Prior Publication Data

US 2005/0110394 A1 May 26, 2005

(30) Foreign Application Priority Data

Nov. 24, 2003 (KR) ..... 10-2003-0083591

(51) Int. Cl.
*H01J 1/62* (2006.01)
*H01J 31/12* (2006.01)

(52) U.S. Cl. ..... 313/495; 313/496; 313/497; 313/309; 313/311

(58) Field of Classification Search ..... None
See application file for complete search history.

(56) References Cited

U.S. PATENT DOCUMENTS 5,530,314 A * 6/1996 Banno et al. ..... 313/310
5,786,659 A 7/1998 Takagi et al.
5,838,095 A * 11/1998 Tanaka et al. ..... 313/309
6,380,671 B1 * 4/2002 Lee ..... 313/495
6,420,726 B2 * 7/2002 Choi et al. ..... 257/10
6,717,340 B2 * 4/2004 Nishimura ..... 313/310
6,976,897 B2 * 12/2005 Choi et al. ..... 445/24
7,034,448 B2 * 4/2006 Lee et al. ..... 313/495
2004/0066132 A1 * 4/2004 Cho et al. ..... 313/495

FOREIGN PATENT DOCUMENTS

| | | |
|---|---|---|
| CN | 1109205 A | 9/1995 |
| CN | 1430241 A | 7/2003 |
| EP | 1 326 264 A2 | 7/2003 |
| JP | 8-102246 | 4/1996 |

OTHER PUBLICATIONS

Patent Abstracts of Japan, Publication No. 08-102246, dated Apr. 16, 1996, in the name of Yuji Maruo.

* cited by examiner

*Primary Examiner*—Sikha Roy
(74) *Attorney, Agent, or Firm*—Christie, Parker & Hale, LLP

(57) ABSTRACT

An electron emission device where the electron emission of the emitter at the respective pixels is uniformly controlled. The electron emission device includes first and second substrates facing each other with a distance, and gate and cathode electrodes formed on the first substrate while interposing an insulating layer. Electron emission sources are electrically connected to the respective cathode electrodes. A resistance layer is disposed between the cathode electrode and the electron emission source in substantially the same plane as the cathode electrode. At least one anode electrode is formed on the second substrate. A phosphor screen is placed on a surface of the anode electrode.

6 Claims, 6 Drawing Sheets

ELECTRON EMISSION DEVICE WITH EMISSION CONTROLLING RESISTANCE LAYER

CROSS REFERENCE TO RELATED APPLICATION

This application claims priority to and the benefit of Korea Patent Application No. 2003-0083591 filed on Nov. 24, 2003 in the Korean Intellectual Property Office, the content of which is incorporated herein by reference.

BACKGROUND OF THE INVENTION (a) Field of the Invention

The present invention relates to a electron emission device, and in particular, to a electron emission device which forms a resistance layer on an electron emission source to uniformly control the electron emission at respective pixels (b) Description of Related Art Generally, the electron emission devices are classified into a first type where a hot cathode is used as an electron emission source, and a second type where a cold cathode is used as the electron emission source. Among the second typed electron emission devices there are field emitter array (FEA) types, surface conduction emitter (SCE) types, metal-insulator-metal (MIM) types, metal-insulator-semiconductor (MIS) types and ballistic electron surface emitting (BSE) types.

The electron emission devices are differentiated in their specific structure depending upon the types thereof, but basically have an electron emission unit placed within a vacuum vessel, and a light emission unit facing the electron emission unit in the vacuum vessel.

Generally, the FEA typed electron emission device has a front substrate and a rear substrate. Emitters are formed on the rear substrate as electron emission sources, together with cathode electrodes and gate electrodes for emitting electrons from the emitters. Phosphor layers are formed on the surface of the front substrate facing the rear substrate, together with an anode electrode receiving high voltages for accelerating the electron beams.

The FEA typed electron emission device commonly has a triode structure with three electrodes. As shown in FIG. 11, gate electrodes 3 are formed on rear substrate 1, and insulating layer 5 is formed on gate electrodes 3. Cathode electrodes 7 are formed on insulating layer 5 while crossing gate electrodes 3. Emitters 9 are formed at the one-sided periphery of cathode electrodes 7 per the respective pixel regions where gate electrodes 3 and cathode electrodes 7 cross each other.

Anode electrode 13 and phosphor layers 15 are formed on the one-sided surface of front substrate 17 facing rear substrate 1, and grid electrode 11 and support 30 are provided between rear substrate 1 and front substrate 17 to focus the electrons emitted from emitters 9.

When driving voltages are applied to cathode electrode 7 and gate electrode 3, a strong electric field due to the voltage difference between the two electrodes is applied to emitter 9, and electrons are emitted from emitter 9. When a positive (+) voltage of several hundreds to several thousands volts is applied to anode electrode 13, the electrons accelerated toward front substrate 17 collide against phosphor layers 15 to emit light.

With the above-structured electron emission device, when the electron emission of emitter 9 is uniformly controlled per the respective pixels, desired grays can be correctly expressed with heightened screen color purity, and the inter-pixel brightness characteristic can be maintained constantly.

However, with the usual FEA typed electron emission device, the shapes of emitters 9 at the respective pixels can be made non-uniformly due to processing differences, and this can result in differences in the electron emission per respective pixels. Furthermore, the electron emission at the pixels where the voltage drop is made due to the internal resistance of cathode electrode 7 and gate electrode 3 may become deteriorated, resulting in uneven electron emission at the respective pixels.

SUMMARY OF THE INVENTION

In accordance with the present invention an electron emission device is provided which uniformly controls the electron emission of the emitter at the respective pixels to correctly express the desired grays with the heightened screen color purity, and which maintains the inter-pixel brightness characteristic in a constant manner.

According to one aspect of the present invention, the electron emission device includes first and second substrates facing each other with a predetermined distance therebetween, and gate and cathode electrodes formed on the first substrate while interposing an insulating layer. Electron emission sources are electrically connected to the respective cathode electrodes. A resistance layer is disposed between the cathode electrode and the electron emission source in substantially the same plane as the cathode electrode. At least one anode electrode is formed on the second substrate. A phosphor screen is placed on a surface of the anode electrode.

According to another aspect of the present invention, the electron emission device includes first and second substrates facing each other with a distance, and at least one gate electrode formed on the first substrate. A plurality of cathode electrodes are formed on the gate electrode while interposing an insulating layer. Electron emission sources are electrically connected to the respective cathode electrodes. A resistance layer is disposed between the cathode electrode and the electron emission source while standing at the same plane as the cathode electrode. At least one anode electrode is formed on the second substrate. A phosphor screen is placed on a surface of the anode electrode.

The electron emission source and the resistance layer may be formed over at least two pixel regions among the pixel regions defined over the first substrate, or separately formed at the respective pixel regions. In the latter case, the electron emission source may be partitioned into two or more parts at the respective pixel regions, and the resistance layer may open at least one side of the electron emission source.

The cathode electrode may have a main striped cathode, and a subsidiary cathode electrically connected to the main striped cathode via the resistance layer while contacting the electron emission source. In this case, the subsidiary cathode and the electron emission source are separately formed at the respective pixel regions defined over the first substrate. The resistance layer may be formed over at least two pixel regions, or separately formed at the respective pixel regions. The electron emission source is partitioned into two or more parts at the respective pixel regions.

Further, the resistance layer may be formed on the entire topmost surface of the first substrate except for the area of the cathode electrode and the electron emission source. The electron emission device may further include counter electrodes facing the electron emission sources with a distance while being electrically connected to the gate electrodes via holes formed at the insulating layer.

The electron emission source may be formed with a carbon-based material or nanometer size material.

DETAILED DESCRIPTION

Figure 1:
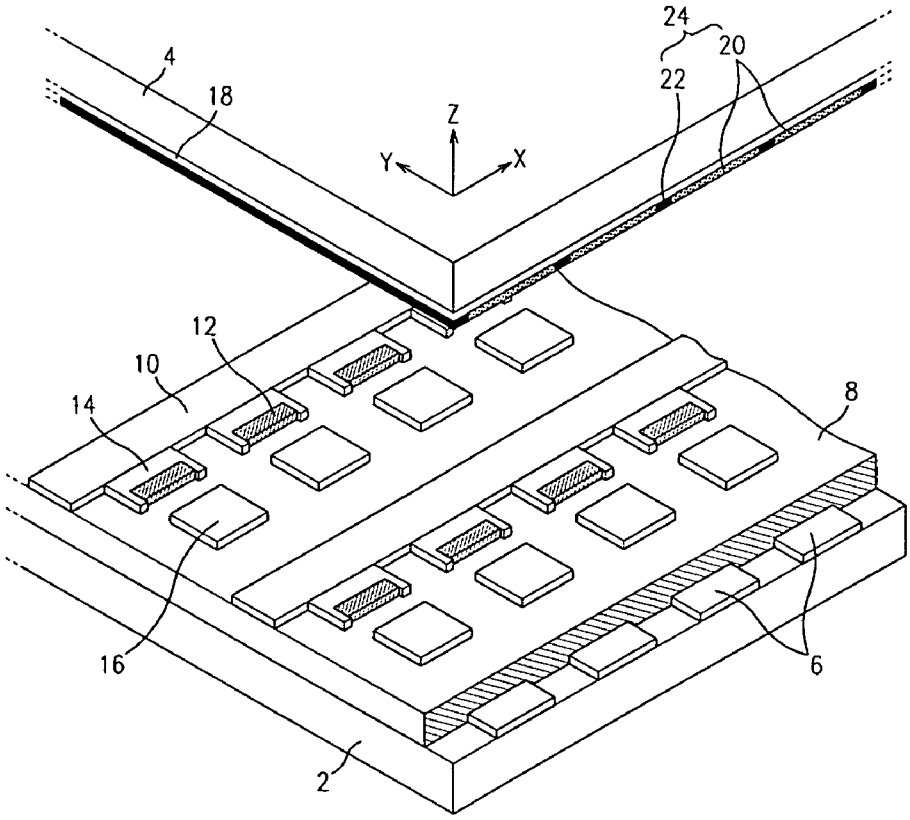
FIG. 1 is a partial exploded perspective view of an electron emission device according to an embodiment of the present invention.
Figure 2:
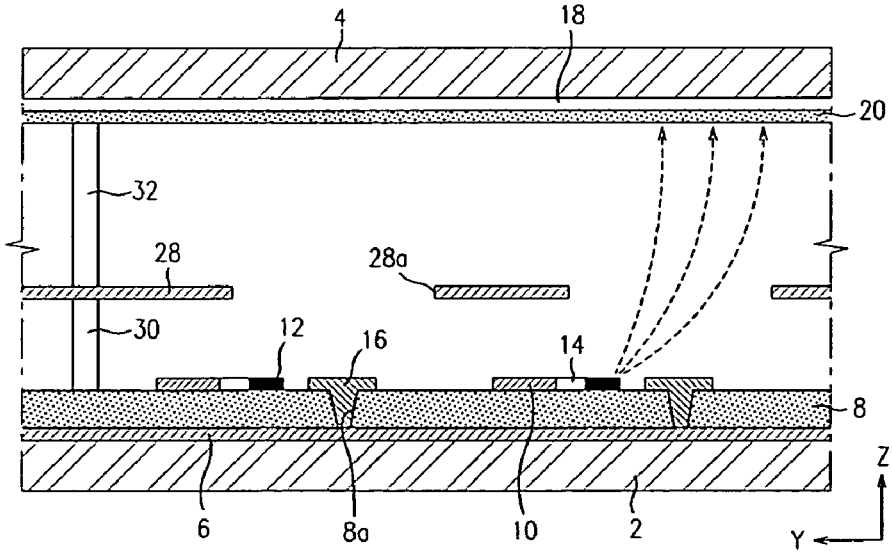
FIG. 2 is a partial sectional view of the electron emission device shown in FIG. 1 illustrating the combinatorial state thereof.
Figure 3:
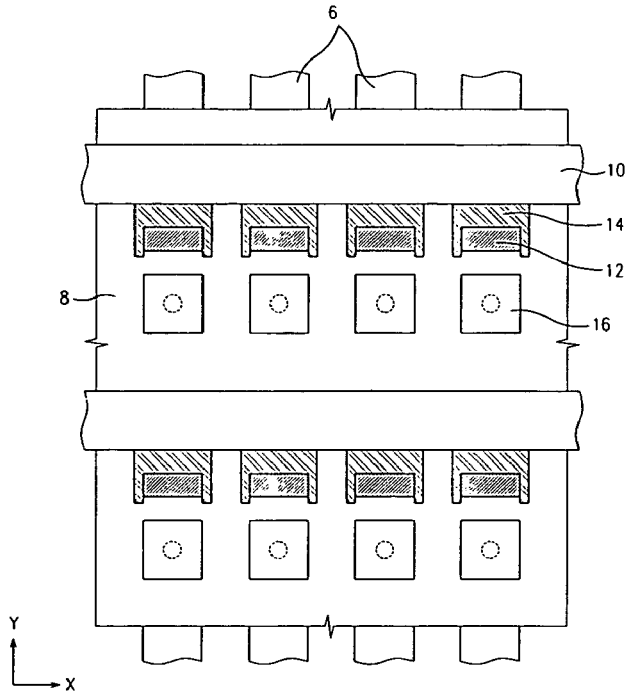
FIG. 3 is a plan view of a first substrate for the electron emission device shown in FIG. 1.

Referring to FIGS. 1-3, an FEA type electron emission device is illustrated. As shown in the drawings, the electron emission device includes first and second substrates 2 and 4 facing each other at a predetermined distance therebetween to form a vacuum vessel. First substrate 2 has an electron emission unit responsive to the formation of electric fields. Second substrate 4 produces visible rays resulting from the electrons from first substrate 2 to display desired images.

Specifically, gate electrodes 6 are stripe-patterned on first substrate 2 in a predetermined direction (in the Y direction of the drawing). Insulating layer 8 is internally formed on the entire surface of first substrate 2 while covering gate electrodes 6. Cathode electrodes 10 are formed on insulating layer 8 in a direction crossing gate electrodes 6 (in the X direction of the drawing). Emitters 12 as electron emission sources are electrically connected to cathode electrodes 10 on insulating layer 8.

Particularly in this embodiment, resistance layer 14 is provided between cathode electrode 10 and emitter 12. Resistance layer 14 electrically connects cathode electrode 10 with emitter 12 while constantly maintaining the resistance between cathode electrode 10 and emitter 12. Resistance layer 14 contacts the lateral side of cathode electrode 10 in substantially the same plane as cathode electrode 10. Resistance layer 14 can have a specific resistance of 0.01-$10^{12}$ Ωcm.

Pixel regions are defined by the regions where gate electrodes 6 and cathode electrodes 10 cross each other, and emitter 12 and resistance layer 14 may be located at the respective pixel regions. Resistance layer 14 opens one side of emitter 12 while covering the three sides thereof. When the opened end portion of emitter 12 is placed internal to resistance layer 14, the inter-pixel electric field intervention can be effectively prevented.

While resistance layer 14 may be formed in a rectangular shape, the shape thereof is not limited to a rectangular shape. The end portion of emitter 12 may correspond to the end portion of resistance layer 14, or be protruded external to resistance layer 14. Furthermore, the end portion of emitter 12 may be formed with a rectilinear shape or a curved shape.

Emitter 12 may be formed with a carbon-based material, such as carbon nanotube, graphite, diamond-like carbon, fulleren ($C_{60}$), or a combination thereof. Alternatively, emitter 12 may be formed with nanometer size material, such as nano-tube, nano-fiber, nano-wire, or a combination thereof. Emitter 12 preferably has a specific resistance of 0.01-$10^{10}$ Ωcm such that it can also provide a resistance layer.

Counter electrodes 16 are formed on first substrate 2 such that they pull up the electric fields at gate electrodes 6 over insulating layer 8. Counter electrodes 16 contact gate electrodes 6 via holes 8*a* formed through insulating layer 8, and are spaced apart from emitters 12 between cathode electrodes 10 a predetermined distance. Counter electrodes 16 pull up the electric fields at gate electrodes 6 to emitters 12 such that stronger electric fields are applied to emitters 12, thereby emitting the electrons from emitters 12.

Anode electrode 18 is formed on the surface of second substrate 4 facing first substrate 2, and phosphor screen 24 is formed on a surface of anode electrode 18 with red, green and blue phosphor layers 20 and black layer 22. Anode electrode 18 is formed with a transparent material, such as indium tin oxide (ITO). A metallic film (not shown) may be formed on phosphor screen 24 to heighten the screen brightness by the metal back effect. In this case, it is possible that the transparent anode electrode is omitted, and the metallic film functions as the anode electrode.

Mesh-typed grid electrode 28 is positioned between first and second substrates 2, 4 with a plurality of apertures 28*a*. Grid electrode 28 focuses the electrons from emitters 12 to heighten the screen color purity, and enhances the voltage resistant characteristic between cathode electrode 10 and anode electrode 18.

Lower spacers 30 are arranged between first substrate 2 and grid electrode 28, and upper spacers 32 are arranged between grid electrode 28 and second substrate 4 to maintain the distance therebetween in a constant manner. For drawing simplification the grid electrode and the upper and the lower spacers are omitted in FIG. 1.

In operation, with the above-structured electron emission device, voltages are applied to gate electrodes 6, cathode electrodes 10, grid electrode 28, and anode electrode 18. For instance, a positive (+) voltage of several to several tens volts is applied to gate electrode 6, and a negative (−) voltage of several to several tens volts is applied to cathode electrode 10. A positive (+) voltage of several tens to several hundreds volts is applied to grid electrode 28, and a positive (+) voltage of several hundreds to several thousands volts is applied to anode electrode 18.

An electric field is formed around emitter 12 due to the voltage difference between gate electrode 6 and cathode electrode 10, and electrons are emitted from the opened end portion of emitter 12 due to the electric field. The emitted electrons are attracted by the positive (+) voltage applied to grid electrode 28 toward second substrate 4. The electrons pass through apertures 28*a* of grid electrode 28, and are accelerated by the high voltage applied to anode electrode 18, thereby colliding against phosphor layers 20 at the respective pixels and displaying the desired images.

When the electrons are emitted from the opening end portion of emitter 12, resistance layer 14 disposed between cathode electrode 10 and emitter 12 constantly maintains the resistance between cathode electrode 10 and emitter 12 to uniformly control the electron emission of emitter 12 at the respective pixels.

In order to show the functional aspect of resistance layer 14, with multiple numbers of electron emission sites where electrons are emitted from the emitters at many pixels, the electron emissions at the respective electron emission sites may be non-uniformly made as a result of the uneven shapes of various emitters 12, and the internal resistance of cathode electrode 10 and gate electrode 6.

However, in accordance with the exemplary embodiment, since resistance layer 14 is exists between cathode electrode 10 and emitter 12, a voltage drop is made at the electron emission sites with significant discharge current through resistance layer 14. Accordingly, the voltage difference between gate electrode 6 and cathode electrode 10 is reduced with the decreased electron emission. In the electron emission sites with little discharge current, the voltage drop is not made at resistance layer 14, or the voltage drop is only slight. Consequently, the desired voltage difference between gate electrode 6 and cathode electrode 10 can be made at the latter electron emission sites.

As a result, the electron emission difference between the two electron emission sites with different discharge current degrees is reduced, thereby enhancing the uniformity in the electron emission per the respective pixels. Therefore, with the electron emission device according to the embodiment of the present invention, the inter-pixel brightness characteristic is kept constant, and desired grays are correctly expressed with heightened screen color purity.

Variations of the first substrate for the electron emission device according to the embodiment of the present invention will be now explained with reference to FIGS. 4 to 10.

Figure 4:
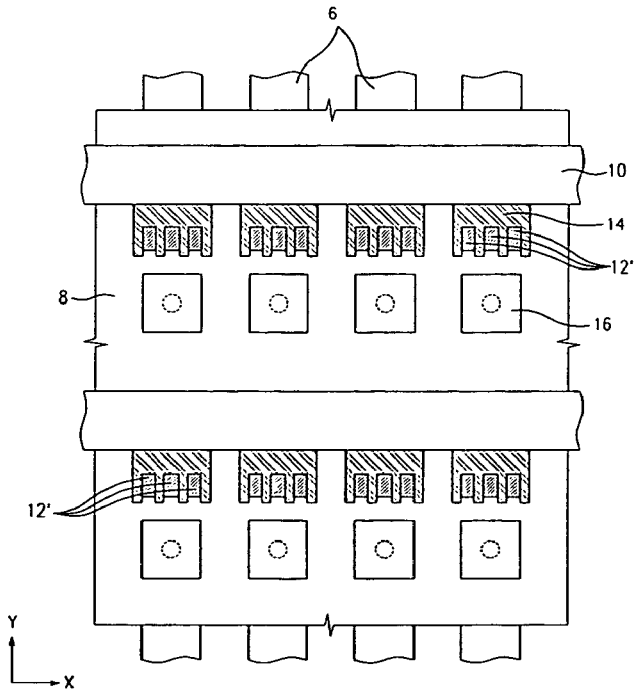
FIG. 4 illustrates a first variation of the first substrate shown in FIG. 3.

FIG. 4 is a first variation of first substrate 2 where emitter 12' at each pixel region is partitioned into two or more parts. With such an emitter structure, the electron emission of emitter 12' at each pixel region can be controlled more uniformly with the specific resistance of resistance layer 14 and respective emitter parts 12'.

Figure 5:
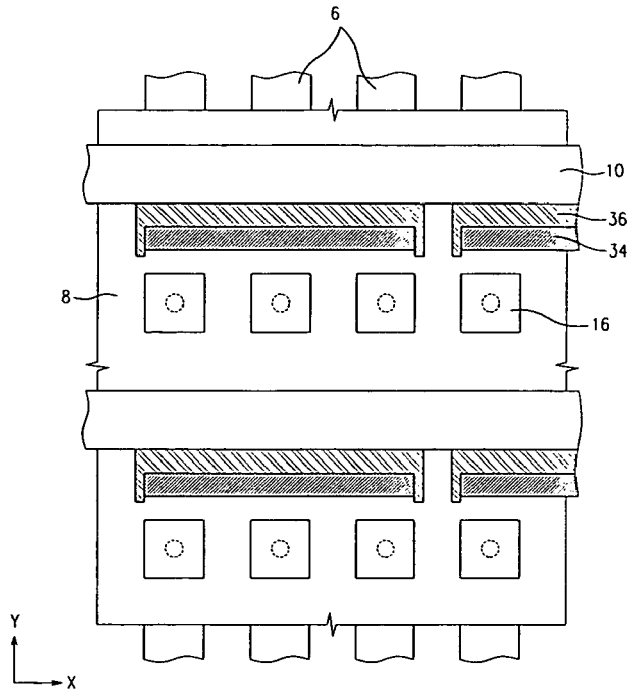
FIG. 5 illustrates a second variation of the first substrate shown in FIG. 3.

FIG. 5 is a second variation of first substrate 2 where emitter 34 and resistance layer 36 are formed over at least two pixel regions, such as over the three pixel regions corresponding to the red, green and blue phosphor layers (not shown). Resistance layer 36 opens one side of emitter 34 while covering the three sides thereof.

Figure 6:
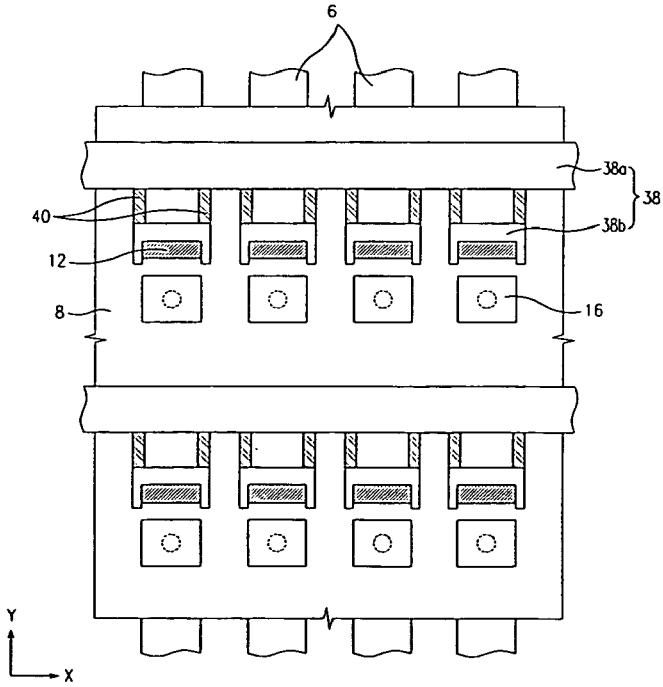
FIGS. 6 to 9 illustrate a third variation of the first substrate shown in FIG. 3.

FIG. 6 is a third variation of first substrate 2 where cathode electrode 38 is formed with main striped cathode 38*a* crossing gate electrode 6, and subsidiary cathode 38*b* electrically connected to main cathode 38*a* via resistance layer 40 while contacting emitter 12. Main cathode 38*a*, resistance layer 40 and subsidiary cathode 38*b* are all placed substantially in the same plane.

In this variation, emitter 12 and subsidiary cathode 38*b* are separately placed at the respective pixel regions, and subsidiary cathode 38*b* opens one side of emitter 12 while covering the three sides thereof.

Figure 7:
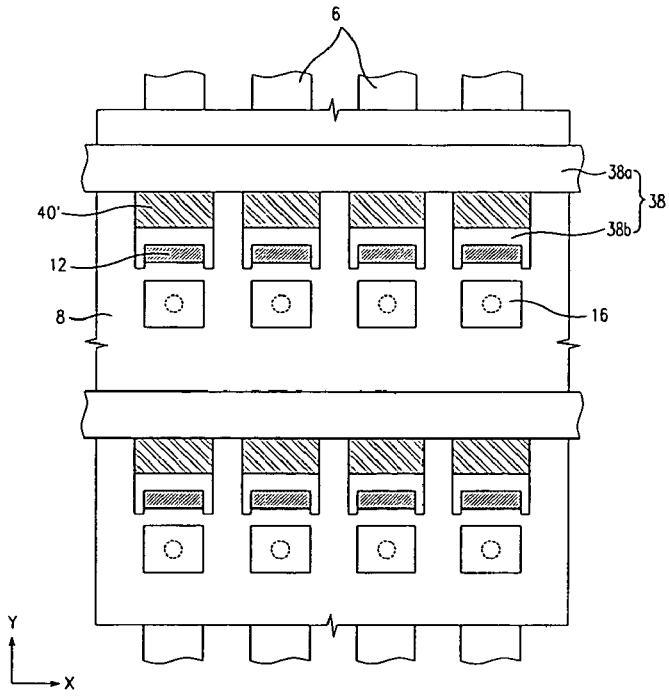
Figure 8:
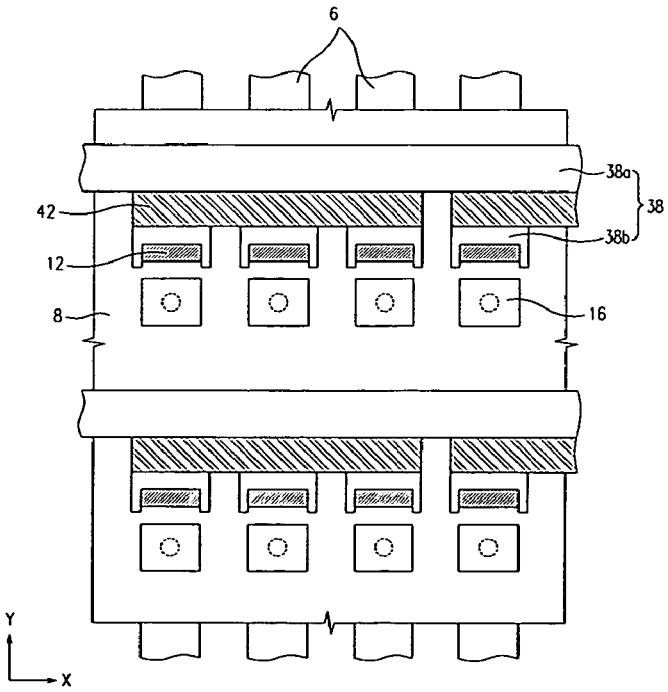

As shown in FIGS. 6 and 7, resistance layers 40, 40' are separately placed at the respective pixels corresponding to subsidiary cathode 38*b*. As shown in FIG. 8, resistance layer 42 may be formed over at least two pixel regions, such as over three pixel regions corresponding to the red, green and blue phosphor layers (not shown).

Figure 9:
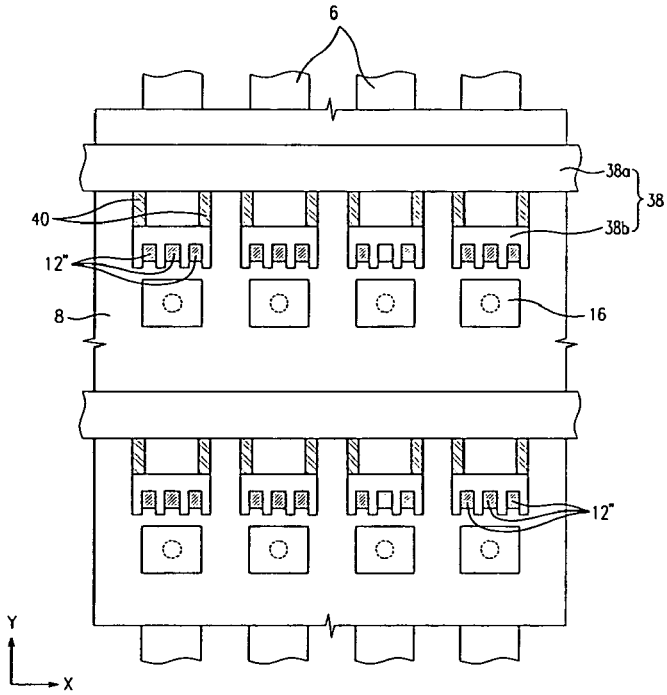

Also, in a second variation, as shown in FIG. 9, emitter 12" may be partitioned into two or more parts at the respective pixel regions.

Figure 10:
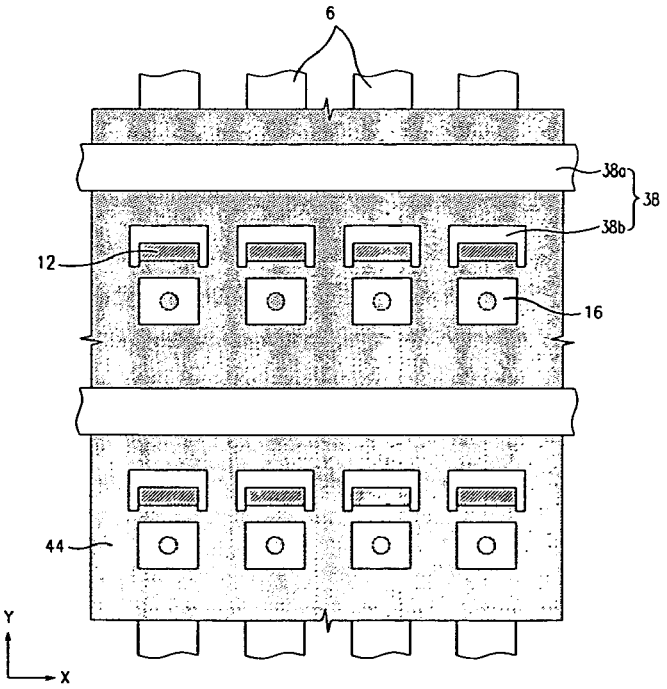
FIG. 10 illustrates a fourth variation of the first substrate shown in FIG. 3.
Figure 11:
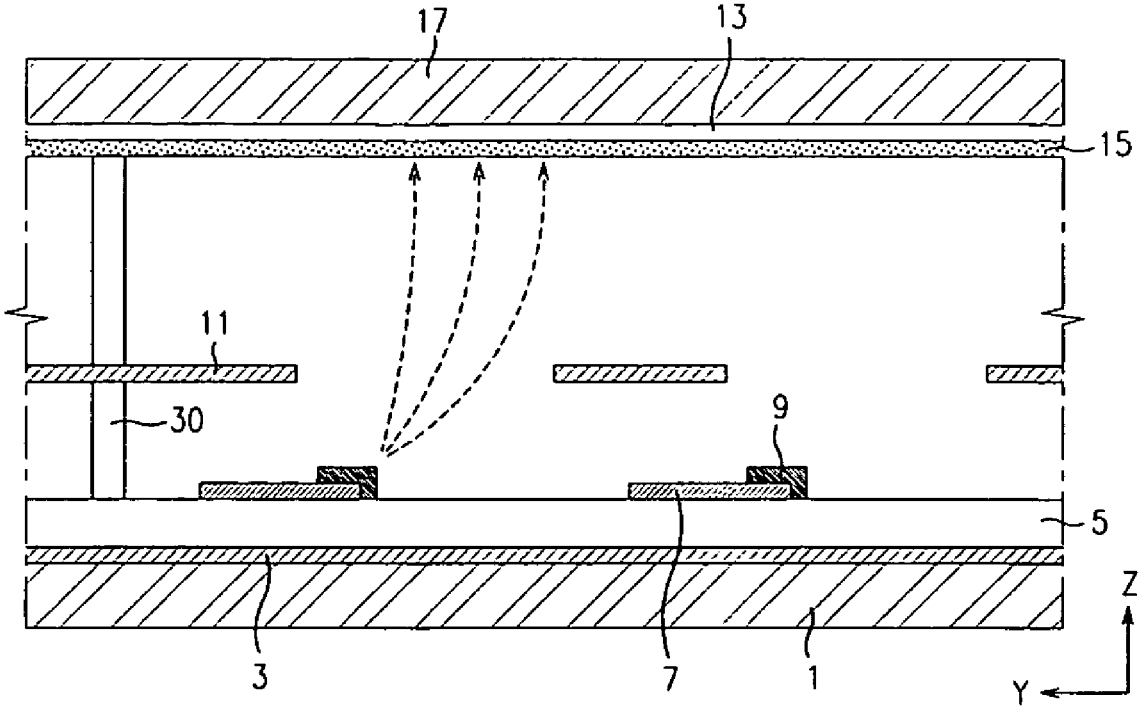
FIG. 11 (Prior Art)
FIG. 11 is a partial sectional view of a FEA typed electron emission device according to a prior art.

FIG. 10 illustrates a fourth variation of first substrate 2 where resistance layer 44 is formed on the entire topmost surface of the first substrate (not shown) except for the area of cathode electrode 38, emitter 12 and counter electrode 16. In the drawing, this variation is illustrated based on the structure of the second variation with subsidiary cathode 38*b*.

The emitter has a structure where the three sides thereof is covered by subsidiary cathode 38*b*, and the remaining one by resistance layer 44. In case subsidiary cathode 38*b* is omitted, resistance layer 44 covers all four sides of emitter 12.

When resistance layer 44 is formed on the entire topmost surface of first substrate 2 except for the area of cathode electrode 38, emitter 12 and counter electrode 16, the electrons are prevented from being accumulated on the insulating layer (not shown), thereby decreasing the possibility of arcing due to the accumulated electrons in an effective manner. Even though resistance layer 44 is formed on the entire topmost surface of first substrate 2, it does not induce any short circuit between cathode electrodes 38 or between cathode electrode 38 and counter electrode 16 due to the resistance value thereof, and effectively conducts its function of uniformly controlling the electron emission of emitter 12 at the respective pixels.

While gate electrodes 6 have been described as stripe-patterned, and anode electrode 18 internally formed on the entire surface of second substrate 4, alternatively, it is also possible that gate electrode 6 is internally formed on the entire surface of first substrate 2, and anode electrodes 18 are stripe-patterned while proceeding in the direction crossing cathode electrodes 10. In the latter case, the pixel region can be defined by the region where the cathode electrode and the anode electrode cross each other.

As described above, with the structure of the electron emission device according to the embodiments of the present invention, the resistance layer disposed between the cathode electrode and the emitter uniformly controls the electron emission of the emitter per the respective pixels. Consequently, the inter-pixel brightness characteristic is kept constant, and desired grays are correctly expressed with heightened screen color purity, thereby improving the image quality.

In the above embodiments, the FEA type is illustrated as the electron emission device. However, the electron emission device of the present invention is not limited to the FEA type.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron emission device comprising;

a first substrate and a second substrate facing each other at a predetermined distance therebetween;

gate electrodes and cathode electrodes formed on the first substrate, the gate electrodes and the cathode electrodes defining a plurality of pixel regions over the first substrate where the gate electrodes and the cathode electrodes cross each other, the first substrate having an insulating layer interposed between the gate electrodes and the cathode electrodes;

electron emission sources electrically connected to the respective cathode electrodes;

a resistance layer disposed between the cathode electrodes and the electron emission sources in substantially the same plane as the cathode electrodes such that the resistance layer surrounds three sides of each of the electron emission sources;

at least one anode electrode formed on the second substrate; and a phosphor screen placed on a surface of the anode electrode.

2. The electron emission device of claim 1, wherein the electron emission sources and the resistance layer are separately formed at each of the plurality of pixel regions defined over the first substrate.

3. The electron emission device of claim 2, wherein the electron emission sources are partitioned into two or more parts at each of the plurality of pixel regions.

4. The electron emission device of claim 1, wherein the electron emission sources and the resistance layer are formed over two or more pixel regions among the plurality of pixel regions defined over the first substrate.

5. The electron emission device of claim 1, further comprising counter electrodes facing the electron emission sources at a distance while being electrically connected to the gate electrodes through holes formed at the insulating layer, wherein a side of the electron emission sources closest to the counter electrodes is uncovered by the resistance layer.

6. The electron emission device of claim 1, wherein the electron emission sources are formed with a carbon-based material or nanometer size material.

* * * * *